US006525247B2

(12) United States Patent
Griffiths

(10) Patent No.: US 6,525,247 B2
(45) **Date of Patent: *Feb. 25, 2003**

(54) END BLOCK FOR ACOUSTIC STRINGED INSTRUMENTS

(76) Inventor: Chris Griffiths, c/o Griffiths Guitars International Ltd. 117 Ropewalk Lane P.O. Box 26027, St. John's, Newfoundland (CA), A1E 5T9

( * ) Notice: Subject to any disclaimer, the term of this patent is extended or adjusted under 35 U.S.C. 154(b) by 0 days.

This patent is subject to a terminal disclaimer.

(21) Appl. No.: 09/759,303

(22) Filed: Jan. 16, 2001

(65) Prior Publication Data

US 2002/0092402 A1 Jul. 18, 2002

(51) Int. Cl.[7] ..... G10D 3/00
(52) U.S. Cl. ..... 84/290; 84/291
(58) Field of Search ..... 84/290, 293, 297 R, 84/267, 291, 292

(56) References Cited

U.S. PATENT DOCUMENTS 4,939,970 A * 7/1990 Hoshino et al. ..... 84/291
5,353,672 A * 10/1994 Stewart ..... 84/267
5,452,637 A * 9/1995 DeCola ..... 84/267
5,469,770 A * 11/1995 Taylor ..... 84/291
6,233,825 B1 * 5/2001 DeGroot ..... 29/896.22
6,350,939 B1 * 2/2002 Griffiths ..... 84/290

* cited by examiner

*Primary Examiner*—Robert E. Nappi
*Assistant Examiner*—Kim Lockett
(74) *Attorney, Agent, or Firm*—Ridout & Maybee LLP

(57) ABSTRACT

An end block for the structural integrity of a body of the stringed instrument is a substantially hollow block having an open face on a body side of the end block, a receiving member projecting inwards from an end wall of the end block, and a plurality of bracing members reinforcing the receiving member to the end wall. The end block provides a larger hollow, a stronger attachment, a lighter instrument and improved sound quality. The end block is a single piece of rigid molded material. Various features on the end block key with corresponding features located in the body of the stringed instrument.

20 Claims, 3 Drawing Sheets

END BLOCK FOR ACOUSTIC STRINGED INSTRUMENTS

FIELD OF THE INVENTION

The invention relates to an end block for an acoustic stringed instrument, such as a guitar.

BACKGROUND OF THE INVENTION

Within the internal cavity of an acoustic instrument, such as a guitar, there are many structural bracing and support members such as braces which are typically made out of wood. The majority of these braces are thin strips fixed with adhesive to the soundboard or the back of the guitar, and don't significantly contact the sides. There are two exceptions. At the point where the neck joins the body and at the opposite end of the body cavity where the two side sections join, there are internal blocks which are required to take significant structural loading. These are often referred to as the neck block and the end block. These blocks are typically of a much larger cross-section than the braces that are fixed to the soundboard and back. These blocks are typically machined from various species of wood using jigs and fixtures.

The end block provides the structural integrity required to stabilize the two side pieces at the end furthest away from the neck block. The end block is normally machined from wood and has a hole drilled through it in order to facilitate the introduction of a strap button or endpin jack. Machining an end block requires multiple steps and significant time investment from a skilled craftsman.

The strap button, as the name suggests, is an attachment for one end of the strap, so that the instrument player may play the guitar standing up. In the case of an endpin jack, the strap button is replaced with an electronic output for guitars which have electronics installed to allow for the instrument to be amplified externally. The end block also provides gluing surface for the sides (the sides of the guitar are made from two separate pieces of wood that meet at the neck block and the heel block) as well as building strength for the strap button or endpin jack. Thus, it is desirable to maximize the size of the end block for structural reasons. However, this increases the weight of the instrument and decreases the size of the hollow of the instrument, which, in turn, decreases sound quality.

As it is difficult for most guitar builders to create a consistent join at the end of the guitar, an end piece or decorative end strip is used to cover the join and add a cosmetic benefit. This is a time consuming and skilled process with no real benefit to the end user.

SUMMARY OF THE INVENTION

The present invention provides an end block for providing structural integrity to an acoustic stringed instrument having a hollow body. The end block is a substantially hollow end block having an open face on a body side of the end block, a receiving member on an end wall of the end block, the receiving member having an aperture through the end wall and the receiving member having a member wall projecting inwards from the end wall, and a plurality of bracing members reinforcing the receiving member to the end wall. The end block may be a single piece of rigid molded material.

The end block may have a front wall projecting perpendicular from the end wall of the end block, and a rear wall projecting perpendicular from the end wall of the end block, the front wall configured to mate with the sound board of the instrument and the rear wall configured to mate with the back wall of the instrument. The end block may have a locating slot on the front wall and a locating slot on the rear wall, the locating slots configured for keying with corresponding protrusions located in the body of the stringed instrument. The end block may have a shoulder between the front wall and the end wall, and a shoulder between the rear wall and the end wall, the shoulders configured to key with corresponding protrusions located in the body of the stringed instrument.

The end block may have a top wall projecting perpendicular from the end wall of the end block, and a bottom wall projecting perpendicular from the end wall of the end block.

The end block may have an end strip positioned medial on the end wall opposite the receiving member and extending from the rear wall to the front wall, the end strip having a strip aperture aligned with the aperture in the end block. The end strip may extend distal past the shoulders, and the shoulders and end strip are configured such that conjointly the shoulders and the end strip key with and secure corresponding protrusions located in the body of the stringed instrument.

The end block may have a projection on the end wall, the projection configured to key with a corresponding cavity on a side of the instrument body. A projection may be on the end wall proximal to the bottom wall, with a further projection on the end wall proximal to the top wall.

The invention also provides an end block for providing structural integrity to an acoustic stringed instrument having a hollow body, the end block comprising a substantially hollow walled structure, a receiving member projecting inwards from an end wall of the walled structure, an aperture extending through the end wall and within the receiving member, a plurality of bracing members reinforcing the receiving member to the end wall of the end block, and an open face on a body side of the end block.

The bracing members may be each arranged perpendicular to the receiving member and perpendicular to the end wall. There may be walls on five sides. Bracing members may extend from the receiving member to the end wall and to at least one other wall.

The invention also provides an end block for providing structural integrity to an acoustic stringed instrument having a hollow body with protrusions along inner edges of the body, comprising a single piece of structure having an end wall and an end strip, the end strip configured to cover a join where the sides of the body meet, and the end wall and the end strip configured to secure the protrusions between the end wall and the end strip.

BRIEF DESCRIPTION OF THE DRAWINGS

A preferred embodiment of the invention will be described with reference to the accompanying drawings, in which.

DETAILED DESCRIPTION OF EMBODIMENTS

Figure 1:
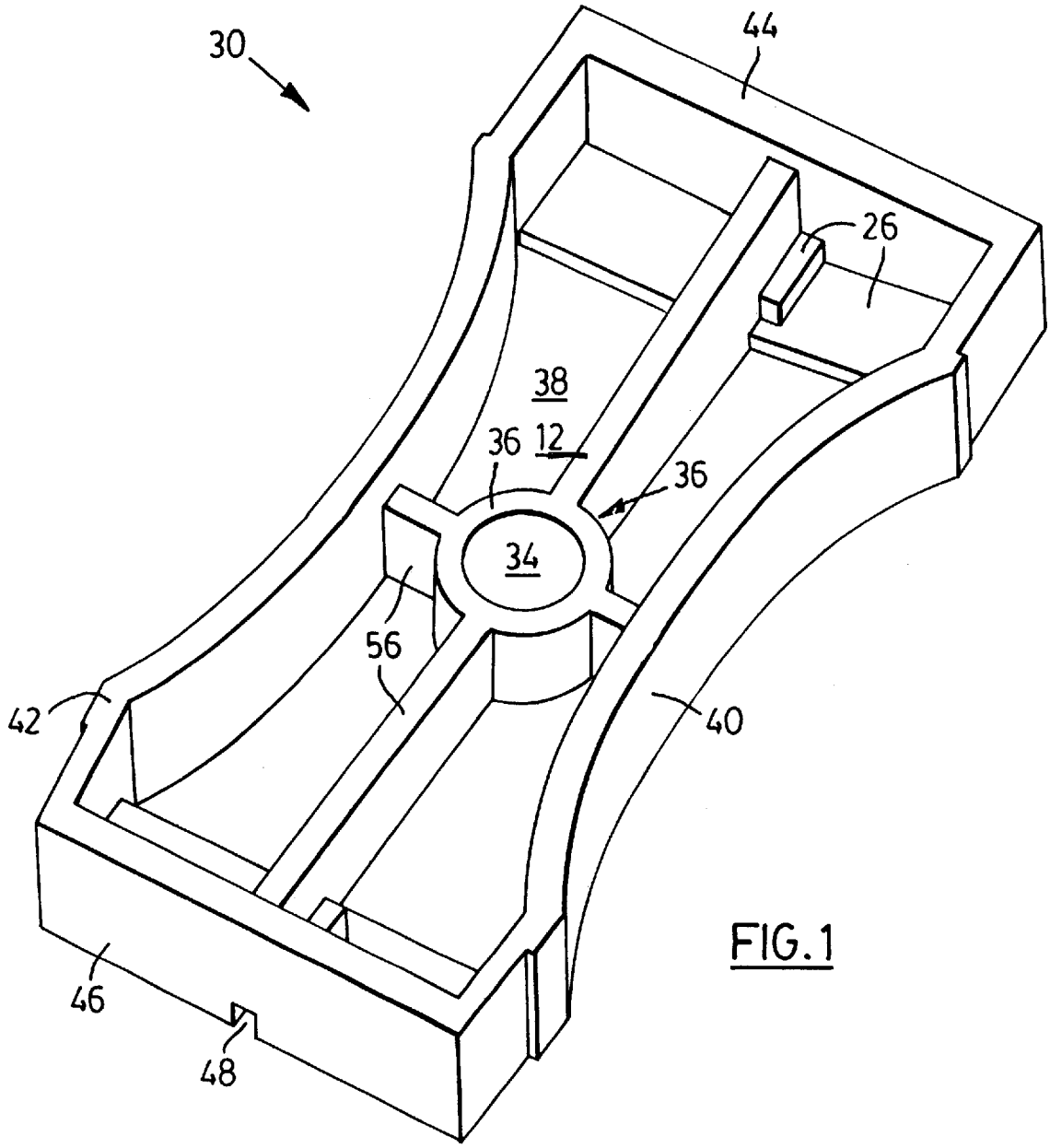
FIG. 1 is a perspective view taken at the body side of an end block according to the present invention.

The present invention provides an improved end block for an acoustic stringed instrument. The new end block is a thin-walled structure with support bracing. This minimizes the weight of the component while maximizing the geometric volume of the sound chamber and providing strength and stiffness where required. Several new features are introduced that enhance the structural stability, the locating accuracy and the assembly of the instrument. Furthermore, while these significant improvements add value and reliability for the end user and create a superior instrument, they also introduce benefits in the manufacturing process-saving time, reducing costs and increasing consistency and quality control in a meaningful and measurable way.

Preferred embodiments of the present invention will now be described in detail with reference to the appended drawings, in which like elements are denoted by like reference numerals.

As shown in FIG. 1, the end block 30 of the invention has a substantially hollow interior. FIG. 1 shows the body side of the end block 30, the body side being an open face 12 which in use faces inwards into the body of the guitar or other stringed instrument. A hollowed receiving member 36 is positioned at the center of the end block. In other embodiments (not shown), the receiving member may be positioned off center. Member 36 has an aperture 34, which extends lengthwise through member 36 and is defined by member wall 35.

Aperture 34 is suitable for receiving bolts, jacks, screws, rivets or other such strap fastening devices, or is suitable for receiving amplifier jacks or other such electronic devices. Where bolts, screws or other jack means are used to fasten a strap to the body of the instrument, these allow for removal and replacement of the strap from the body and allow for tightening the strap to the body as may be necessary with the passage of time and fluctuations in temperature and humidity.

Receiving member 36 is reinforced by bracing members 56 which are integral to the end block 30 and project substantially perpendicular from end wall 38. Bracing members are in turn reinforced by further being integral with top wall 40, bottom wall 42, front wall 44 or rear wall 46. Bracing members 56 provide strength to receiving members 36 to withstand the substantial forces at the end block, without requiring a large, solid (non-hollow) end block. In the embodiment shown, receiving member 36 has four bracing members 56 which are arranged perpendicular to adjacent bracing members. It will be appreciated that different bracing systems and different numbers of bracing members can be arranged within the substantially hollow structure of the end block in place of those illustrated. Also, as shown in FIG. 1, wall bracing 26 may be provided to share structural load and thus increase structural support between the walls and/or between the walls and the bracing members.

Figure 2:
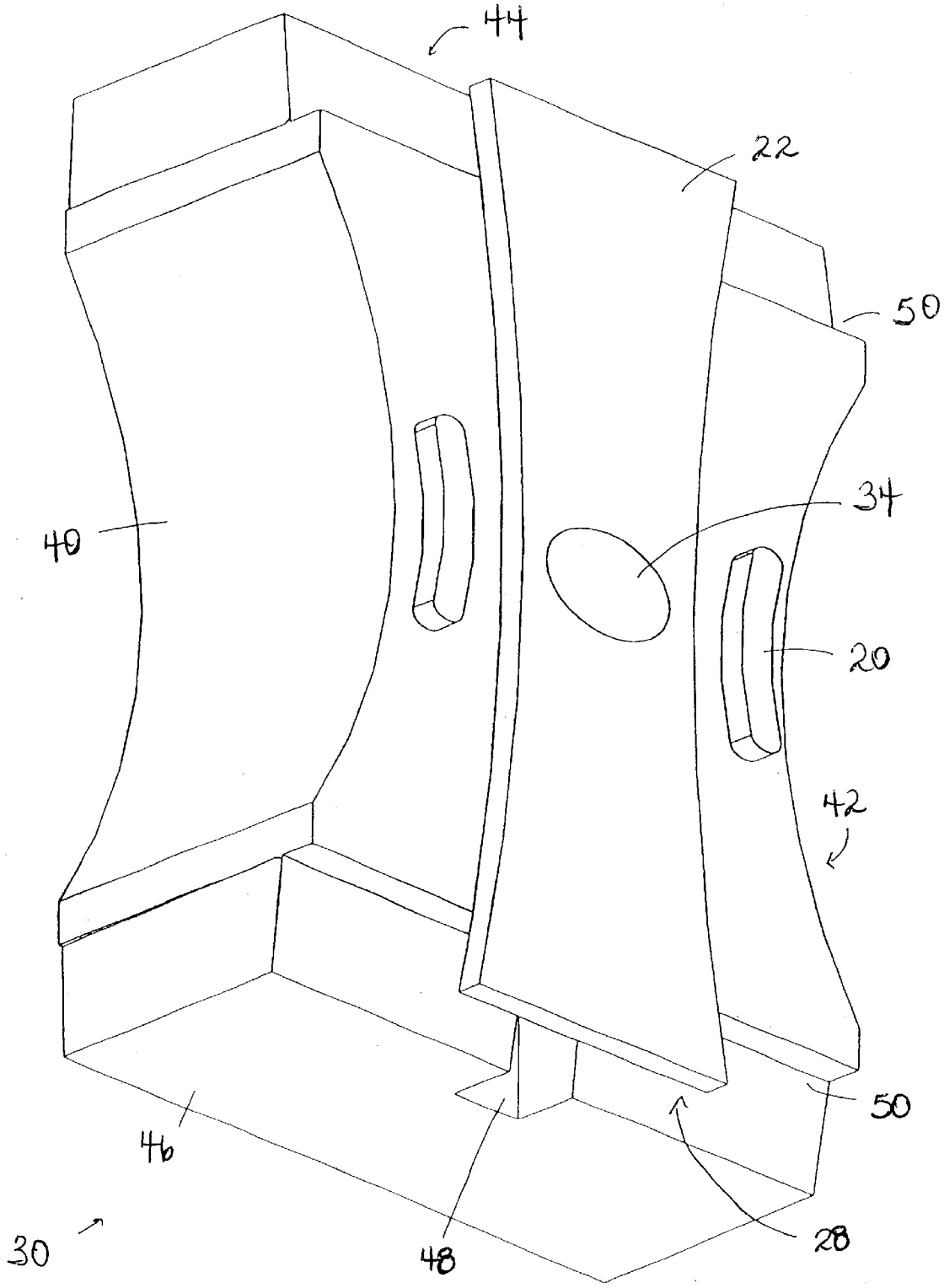
FIG. 2 is a perspective view taken at the end side of an end block according to the present invention.

In the embodiment best shown in FIG. 1 and FIG. 2, end block 30 has five walls, comprising end wall 38, top wall 40, bottom wall 42, front wall 44 and rear wall 46. However, for some uses, the end block may not require five walls. At a minimum, one end wall is required, with bolt or joint receiving means and bracing. It will be appreciated, however, that the front, rear, top and bottom walls, both individually and collectively (because they form one integral part), provide valuable strength and support to the end block. Three walls of the end block can be gluing surfaces. Front wall 44 is a generally flat surface, corresponding to the flat surface of the interior of the instrument's front (i.e. the sound board). Rear wall 46 is slightly bowed to follow the bow normally found in the rear of the instrument (i.e. back).

Figure 3:
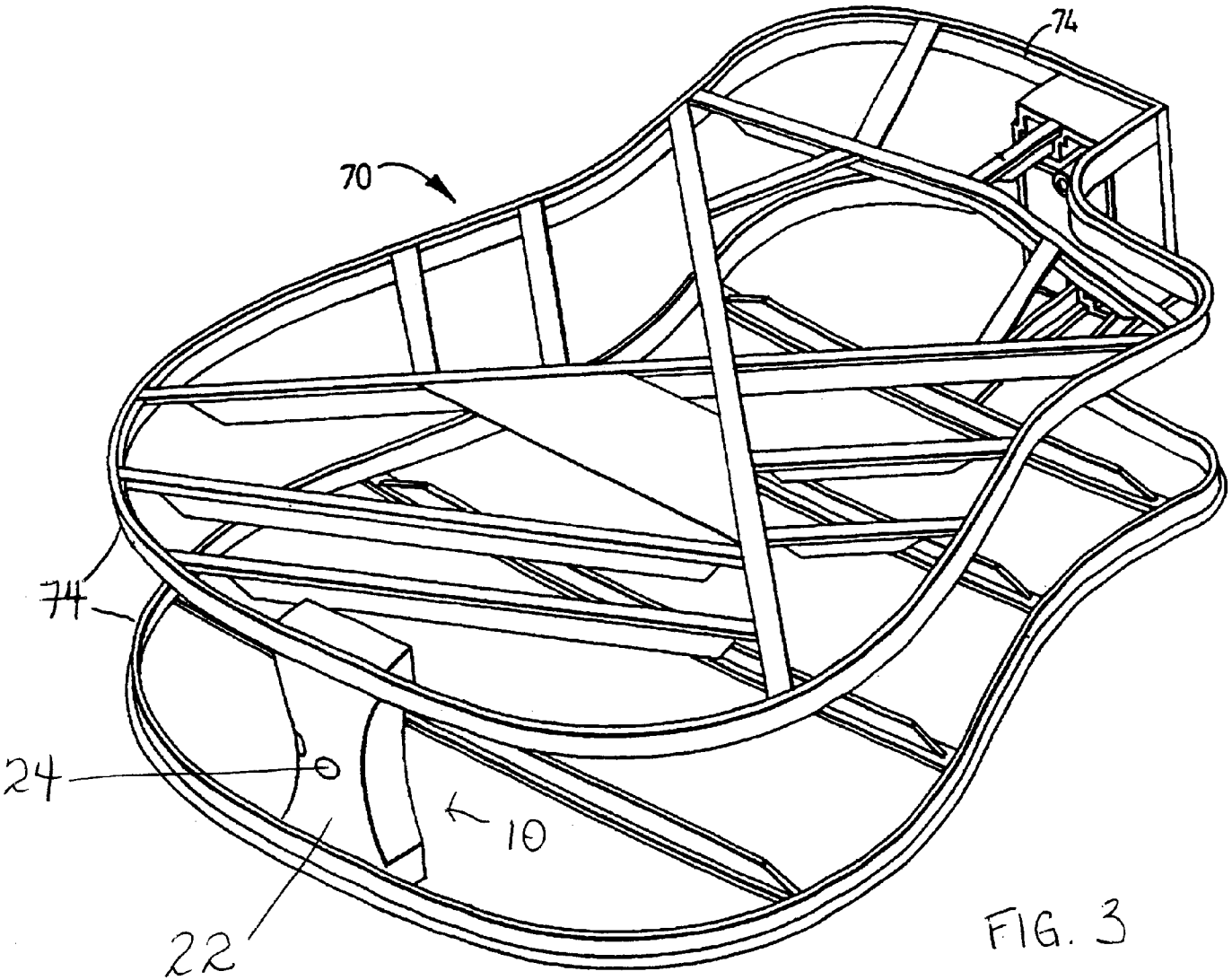
FIG. 3 is a perspective view of an end block according to the present invention assembled in a guitar body.

Also new over the prior art, locating slots 48 are incorporated into the front wall 44 and rear wall 46 of the end block at the median of the end block. These slots act as keying features to locate the end block along a length of bracing located on the soundboard and back board of the body. This ensures that the orientation between the end block and body of the guitar or other instrument is square and consistent from one guitar to the next. These slots accept a central, foremost projection on bracing frames positioned in the interior of the body 70 to form a dado joint, as seen in FIG. 3. This increases the strength of the bond between the end block and the body of the instrument.

An end wall shoulder 50 is located between the end wall 38 and the front wall 44, and another end wall shoulder 50 is located between the end wall 38 and the rear wall 46. The end wall shoulders 50 are configured to key with body frame 74 to form a rabbet joint, as best seen in FIG. 3.

As seen in FIG. 2, projections 20 are available to key into corresponding cavities in the side walls of the instrument to ensure that the instrument is square in both vertical and horizontal positions and to reinforce the strength of the body and increase tone transfer between the end block and the body of the instrument.

In order to utilize a single molded block for assembly of the instrument, without the need for a separate end strip, a molded end strip 22 has been incorporated into the end block, as shown in FIG. 2. The end strip 22 is positioned medial on the exterior of end wall 38, the end strip extending from the rear wall 46 to the front wall 44. Aperture 34 extends through the end strip 22. End strip 22 covers the join between the two side walls of the instrument wall, and serves a decorative purpose, covering the section where two side wall pieces of the body of the instrument meet at the end block. Various patterns and designs may be used for the end strip.

With end blocks of the prior art, manufacturers would add an end block using several separate steps. In the present invention, this preformed strip is already incorporated into the end block, the saving time and expense. Upon assembly of the instrument, an inner edge 74 of body 70 fits into a shoulder slot 28 (see FIG. 2) formed by shoulder 50 and the distal ends of end strip 22, to ensure that the block is appropriately positioned and to increase the strength of the body when assembled.

Other keying structures which are suitable for the invention may be used, so long as security of attachment is provided between the end block and the body of the instrument.

In production, the material that is injection molded is a long strand glass fibre with resin composite. Glass is utilized as it transmits vibrations very effectively. Other material may be suitable. For example, the end block may be made from materials such as thermopolymers, graphite or the like.

The end block of the invention is particularly suitable for use in association with the Griffiths Active Bracing System™ (GABS™), which is described in U.S. patent application Ser. No. 09/492,809, now Pat. No. 6,333,454 of the present inventor. This arrangement is seen in FIG. 3. However, the end block is also suitable as a simple replacement for traditional blocks. The end block is easily modified to fit any manufacturer's acoustic line. If necessary, body edges 74 can be readily affixed to the interior of bodies of the acoustic stringed instrument.

The present invention, as opposed to any other known means, provides other significant benefits.

The end block has been designed as a thin-walled structure with support bracing. The end block weighs less than prior art components of the same overall dimensions. This allows for a reduction in overall weight of the instrument while maximizing the geometric volume of the sound chamber, thus improving sound quality and providing stiffness where required.

Locating slots 48 as well as shoulders 50 and shoulder slot 28 act as keying and securing features to self index and locate the end block along the length of the bracing, binding, ribs or frame of the body to ensure that the instrument's overall structure is square and consistent from one guitar to the next, and to increase strength and durability. This allows for increased quality control during the assembly process as it ensures that the parts are correctly placed every time.

Due to the manner in which the end block indexes with the edges of the body of the guitar, the end block is vastly stronger than a traditional end block as the kerfing, binding, rib, frame or brace sections of the bracing system add significant strength. In other words, the strength of the edging, having locked into place with the end block, resists the tension of the strap button better than the traditional methods which rely solely on the strength of the end block and the surfaces of the body to which it is glued. These features also ensure that the end block is placed accurately and consistently in both vertical and horizontal positions and allowing for perfect mating, extra strength and an extra level of cosmetic adornment that would normally be too complicated and time consuming in the standard manufacturing process.

The molded-in end strip allows for easy assembly and installation of the end block, as compared to the prior art which requires further manufacturing, machining and assembly steps. In the prior art, manufacturers would perform this operation (i.e., adding am end strip) in several additional separate steps. In the case of the end block of the present invention, this strip is an integral part of the end block for mating with inner edges of the body. Also by the present invention, either simple or complicated decorative designs may be used without incurring significant costs in preparing and installing the strip.

The blocks can be injection molded instead of machined which results in extremely fast cycle/manufacturing times for the part (approximately 20–25 seconds each). The parts produced are the same every single time. The end block may be cast from a desired material, and is then ready for assembly. No drilling puncturing or machining is required, reducing the cost of producing the end block.

The holes for the strap bolts and/or jack are preformed in the end block to eliminate the drilling process from the construction task, allowing for perfect part mating, extra strength and an extra level of cosmetic adornment that would otherwise be too complicated and time consuming in a standard manufacturing process. This feature also helps to ensure that the structure is consistent from one guitar to the next.

In an embodiment, the material that is injection molded is a long strand glass fibre with resin composite. Glass is utilized for this part as it transmits vibrations very effectively, providing improved sound quality, and it is very strong when added with the resin composite. With injection molding, different types of glass fibre and resin composites can be used to modify the strength and tone transfer between the body and the end block.

Another benefit of the present means for attachment is that the end block can be used with traditional guitar designs. No special adaptation of the body is required.

The above description with reference to the illustrations is considered to be illustrative and not restrictive in character. The true scope and spirit of the invention resides in the appended claims and their legal equivalents, rather than by the given examples. Modifications and variations on the embodiments described or known to those skilled in the art may be made within the scope of the invention.

I claim:

1. An end block for providing structural integrity to an acoustic stringed instrument having a hollow body, said end block comprising a substantially hollow end block having an open face on a body side of said end block, a receiving member on an end wall of said end block, said receiving member having an aperture through said end wall and said receiving member having a member wall projecting inwards from said end wall, and a plurality of bracing members reinforcing said receiving member to said end wall.

2. An end block as claimed in claim 1, wherein said end block is a single piece of rigid molded material.

3. An end block as claimed in claim 1, wherein said end block further comprises a front wall projecting perpendicular from said end wall of said end block, and a rear wall projecting perpendicular from said end wall of said end block, and said front wall is configured to mate with the sound board of said instrument and said rear wall is configured to mate with the back wall of said instrument.

4. An end block as claimed in claim 3, wherein said end block further comprises a locating slot on said front wall and a locating slot on said rear wall, said locating slots configured for keying with corresponding protrusions located in said body of said stringed instrument.

5. An end block as claimed in claim 1, wherein said end block further comprises a top wall projecting perpendicular from said end wall of said end block, and a bottom wall projecting perpendicular from said end wall of said end block.

6. An end block as claimed in claim 3, wherein said end block further comprises a shoulder between said front wall and said end wall, and a shoulder between said rear wall and said end wall, said shoulders configured to key with corresponding protrusions located in said body of said stringed instrument.

7. An end block as claimed in claim 1, wherein said end block further comprises an end strip positioned medial on said end wall opposite said receiving member and extending from said rear wall to said front wall, said end strip having a strip aperture aligned with said aperture in said end block.

8. An end block as claimed in claim 7, wherein said end block further comprises a shoulder between said front wall and said end wall, and a shoulder between said rear wall and said end wall, and said end strip extends distal past said shoulders, and said shoulders and end strip are configured such that conjointly said shoulders and said end strip key with and secure corresponding protrusions located in the body of said stringed instrument.

9. An end block as claimed in claim 1, wherein said end block further comprises a projection on said end wall, said projection configured to key with a corresponding cavity on a side wall of said body.

10. An end block as claimed in claim 9, said end block further comprising said projection on said end wall proximal to said bottom wall, and a further said projection on said end wall proximal to said top wall.

11. An end block for providing structural integrity to an acoustic stringed instrument with a hollow body, said end block comprising a substantially hollow walled structure, a receiving member projecting inwards from an end wall of said walled structure, an aperture extending through said end wall and within said receiving member, a plurality of bracing members reinforcing said receiving member to said end wall of said end block, and an open face on a body side of said end block.

12. An end block as claimed in claim 11, wherein said end block is a single piece of rigid material.

13. An end block as claimed in claim 11, wherein said end block further comprises a locating slot on said walled structure, said locating slot configured for keying with a corresponding protrusion located on said body of said stringed instrument.

14. An end block as claimed in claim 11 wherein said bracing members are each arranged perpendicular to said receiving member and perpendicular to said end wall.

15. An end block as claimed in claim 11, wherein said walled structure has walls on five sides.

16. An end block as claimed in claim 14 wherein each said bracing member extends from said receiving member to said end wall and to at least one other wall.

17. An end block as claimed in claim 11, wherein said end block further comprises an end strip positioned medial on said end wall opposite said receiving member and extending from said rear wall to said front wall, said end strip having a strip aperture aligned with said aperture in said end block.

18. An end block as claimed in claim 11, wherein said end block further comprises a shoulder between said front wall and said end wall, and a shoulder between said rear wall and said end wall, and said end strip extends distal past said shoulders, and said shoulders and end strip are configured such that conjointly said shoulders and said end strip key with and secure to corresponding protrusions located in the body of said stringed instrument.

19. An end block as claimed in claim 1, wherein said end block further comprises a projection on said end wall proximal to said bottom wall, and a further projection on said end wall proximal to said top wall, said projections each configured to key with a corresponding cavity on a side wall of said body.

20. An end block for providing structural integrity to an acoustic stringed instrument having a hollow body with protrusions along inner edges of said body, comprising a single piece of structure having an end wall and an end strip, said end strip configured to cover a joint where sides of said body meet, and said end wall and said end strip configured to secure said protrusions between said end wall and said end strip.

* * * * *